US007737900B1

(12) United States Patent
Saindon

(10) Patent No.: US 7,737,900 B1
(45) Date of Patent: Jun. 15, 2010

(54) MOBILE SATELLITE DISH ANTENNA STAND

(76) Inventor: Delmar L. Saindon, 16410 - 84th St. NE., 0204, Lake Stevens, WA (US) 98258

( * ) Notice: Subject to any disclaimer, the term of this patent is extended or adjusted under 35 U.S.C. 154(b) by 199 days.

(21) Appl. No.: 12/131,663

(22) Filed: Jun. 2, 2008

Related U.S. Application Data

(60) Provisional application No. 60/944,745, filed on Jun. 18, 2007.

(51) Int. Cl.
*H01Q 3/00* (2006.01)
*H01Q 3/02* (2006.01)

(52) U.S. Cl. ..... 343/760; 343/757; 343/880; 343/882

(58) Field of Classification Search ..... 343/757, 343/760, 765, 878, 880, 882
See application file for complete search history.

(56) References Cited

U.S. PATENT DOCUMENTS 5,517,204 A * 5/1996 Murakoshi et al. ..... 343/765
5,870,059 A * 2/1999 Reynolds ..... 343/760
6,366,253 B1 * 4/2002 Hemmingsen, II ..... 343/760
6,697,026 B1 * 2/2004 Hemmingsen, II ..... 343/760
6,850,202 B2 * 2/2005 Watson ..... 343/766
7,142,168 B1 * 11/2006 Sinclair ..... 343/882

* cited by examiner

*Primary Examiner*—Hoang V Nguyen
(74) *Attorney, Agent, or Firm*—David L. Tingey

(57) ABSTRACT

The mobile antenna stand provides adjustments in azimuth, tilt, and elevation used to obtain a satellite signal. The stand may be placed on unlevel ground of up to 11 inches difference in terrain heights. The stand includes a compass with azimuth readings which provides known starting point for the azimuth setting. The mast is easily plumbed regardless of the terrain. The satellite dish antenna is attached to a keyed post that matches a keyed receiver on the stand so the azimuthal position of the antenna is maintained when the antenna is removed and reinstalled. A line of sight tool is provided with a post also matching the stand receiver to visually assure that view of a signal transmitting satellite by the antenna has no obstructions.

20 Claims, 6 Drawing Sheets

MOBILE SATELLITE DISH ANTENNA STAND

This application claims priority by way of that provisional application filed Jun. 18, 2007 and assigned Ser. No. 60/944,745

BACKGROUND

1. Field of Invention

This invention relates to the installation of a satellite dish antenna, and more specifically to a mobile stand on which to mount an antenna.

2. Prior Art

The installation of a permanent television satellite dish antenna is generally by a professional provided by a network service provider. However mobile television users such as recreational vehicle (RV) users do not have professional installers available. Some RVs have a permanently mounted satellite antenna on the roof. These systems are expensive with GPS and other devices to help with setup but they still do not obtain a satellite signal all of the time. Some RV sites, because of the location of trees and other obstructions, leave the permanently mounted satellite antenna with an obstructed view. When the use of a permanently mounted dish antenna's view is obstructed or there is not a permanently mounted antenna, the mobile user needs to be able to deploy the satellite dish antenna at locations that have a clear view to the satellite. Thus, the mobile user becomes the installer out of necessity.

There are satellite dish antenna stands that allow you to install in these situations; however, they have limitations. One of the limitations is the need to find a level location. Some use a tri-pod stand with a bubble level but it can be somewhat difficult to perform the necessary adjustment to obtain the level status. In addition, the mast on most of these mobile stands has some flexibility resulting in a mast that is not a true 90 degrees to the base. If the base and mast are not at 90 degrees, having the base level does not result in having the mast plumb.

Most, if not all, stands and/or alignment devices have relied on adjustment capability on the satellite dish antenna itself for adjustment. To obtain the strongest azimuth setting nuts holding the antenna to its mast must be loosened, slipping the antenna left and right on the mast and then securing the nuts again. The elevation on a smaller dish antenna with a 1⅝ OD post is adjusted by loosening nuts on both sides of a bracket and holding the antenna with both hands, moving it up and down. The signal is located and the nuts are secured while attempting to maintain the adjustment position with no change to the signal strength. Because of a small amount of play in the mast one needs to hold the satellite dish antenna steady with one hand and secure the nuts locking the elevation with the other. However even minor changes in elevation results in reduced signal strength. Final adjustment in this way is frustrating and time consuming while seldom resulting in less than the strongest setting available. However due to rain fade from inclement weather between the satellite and the satellite dish antenna, the signal strength needs to be as strong as possible to have good reception.

The primary object of the antenna stand of the present invention is to provide a stand with simple, easy and quick adjustments that result in an optimum reception of a satellite signal. For the smaller satellite dishes that fit the 1⅝ inch OD post, the object is to provide adjustments in azimuth, tilt, and elevation. For newer dish antennas that fits a 2 inch and larger outer diameter (OD) post that has improved elevation and tilt gauges, the object is to provide an azimuth gauge. A further object is to provide a tool for visually assuring an unobstructed antenna view of the location in the sky of a signal transmitting satellite.

SUMMARY

All mobile dish satellite antennas have a bracket on the back side of the antenna that attaches to a mast supported by a mounting bracket or stand. The present invention discloses a stand for such a mobile antenna that includes an adjustable mast on a stand base and a post that removably attaches to the mast with the antenna affixed to the post.

The objects of the invention are achieved in a mobile antenna stand with a plurality of legs, typically four, each with an adjustment length of up to 11 inches. This allows the stand to be used even where the terrain is very uneven. An elevation setting on a stand mast and rotation of a platform to a selective azimuth setting obtains an initial antenna direction. Final adjustment of the legs provides a final adjustment to maximize satellite signal strength. The antenna includes a keyed post that connects to an antenna mast, which mast can be inserted in only one direction into a matching keyed receiver in the stand thereby assuring that the dish antenna can be removed from the stand and re-inserted without losing its azimuthal alignment. When the stand is aligned to magnetic North the satellite dish antenna will also be aligned to a magnetic North and will not lose its alignment when it is removed.

The antenna may be removed, for example, to check if there is an obstruction in view of the antenna. A line of sight tool is provided that uses a same keyed post to fit into the stand receiver. Consequently, it will have the same alignment as the satellite dish antenna. Satellite dish antennas benefit from an unobstructed view; that is, the path between the satellite and the dish is unobstructed, such as by a tree, a post, or a structure which may decrease the transmission of a signal from the satellite to the antennal. When an unobstructed view is in question, it is tested visually with the line of sight tool installed in the stand instead of the satellite dish antenna.

An extension is also provided for convenience of the user. Because the mast and the extension are keyed so they can only be inserted into the stand in one direction only the mast and the extension and therefore the antenna are always in alignment with the azimuth setting of the stand. Use of multiple antenna posts is anticipated: a smaller standard post with a 1⅝ inch OD and a larger post with a 2 inch OD and some with over 2 inch OD. Because both the standard post and the larger post are keyed to fit into the stand in the same single direction and one of posts is permanently attached to the satellite dish antenna, when the satellite dish antenna is removed it can be reinstalled on the stand and still have the correct orientation with the stand without additional adjustment.

Threaded rod legs are used to fine tune the elevation and to assure the mast is plumb. With antenna settings approximated, only one hand is necessary to fine tune the antenna orientation. Otherwise, adjustment requires the use of both hands: one to hold the desired placement and the other to secure the nuts. Not having to change the settings on the satellite dish antenna simplifies the task and does not require the use of both hands. When the final adjustment is made, the directional settings will not change, leaving the strength level in the high ranges and reducing the effect of rain fade.

The small antenna with a 1⅝ OD post is used for television reception. Once the small satellite dish antenna is installed and calibrated to the stand no tools are needed when setting up at a different location. Elevation and skew are set to neutral settings and do not change at a different location. Adjustment for fine tuning and for small differences due to a change of location is made by adjusting the threaded legs. The satellite signal strength remains in the highest range, even though there may be some reduction due to environmental effects such as rain.

A larger dish antenna with a 2 inch or larger OD post is used for Internet or HDTV (High Definition Television) reception. There is a separate post with a built-in mast for these satellite dish antennas. These larger antennas also have an improved elevation gauge that uses an adjustment bolt to adjust the elevation, or pitch. The tilt, or roll adjustment was also improved so the only gauge built into the stand, for this larger dish antenna, is for the azimuth, or yaw settings.

REFERENCE NUMBERS USED IN THE DRAWINGS

Figure 1:
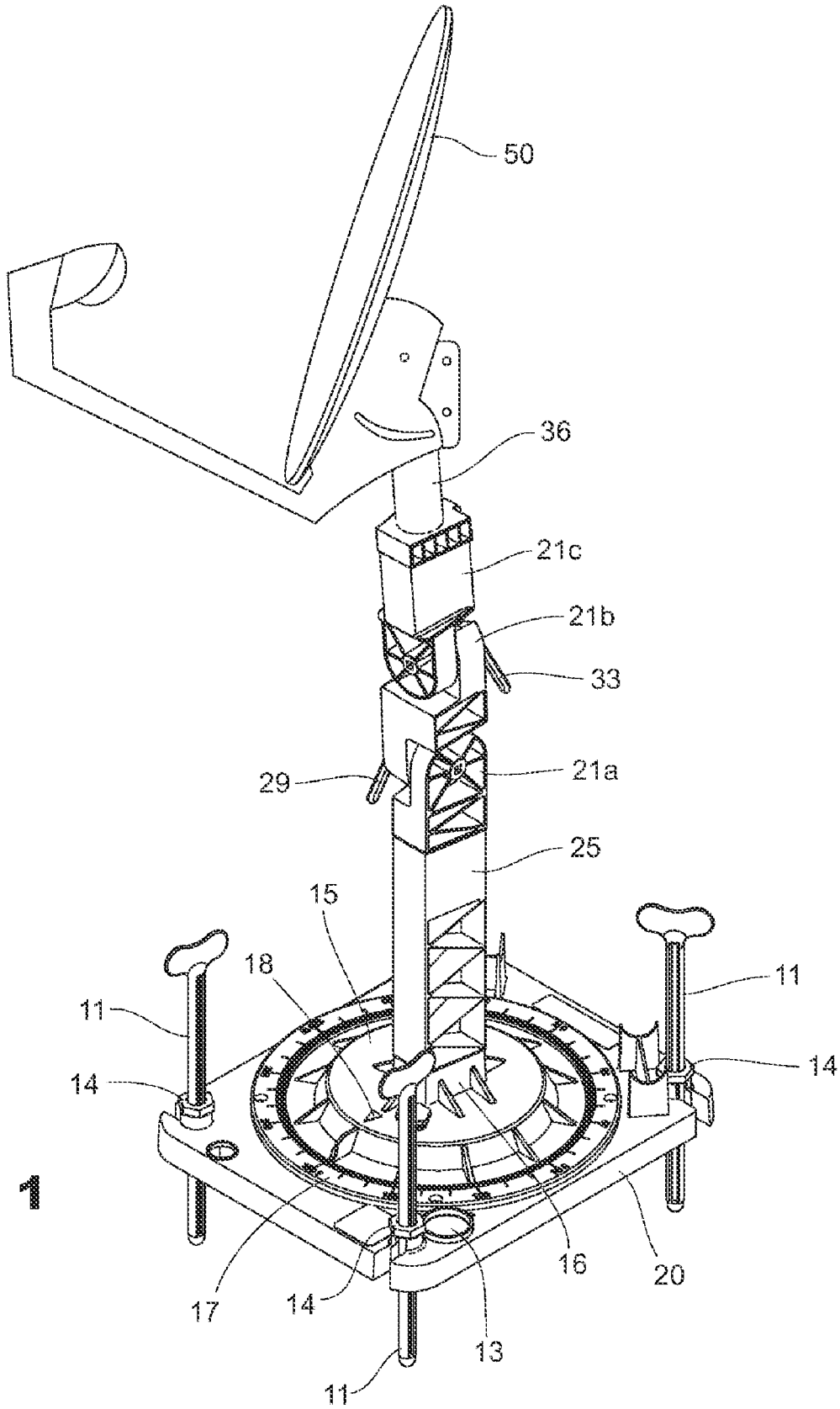
FIG. 1 is perspective view of the stand of the present invention with a satellite dish antenna of the prior art mounted thereon.

| | |
|---|---|
| 11 | Threaded legs |
| 12 | Base locking knob |
| 13 | Compass |
| 14 | Nylon retaining nut |
| 15 | Cone platform |
| 16 | Keyed receiver |
| 17 | Azimuth retaining ring |
| 18 | Azimuth alignment arrow |
| 19 | Retaining ring bolts |
| 20 | Stand base |
| 21 | Standard mast |
| 21A | Standard mast lower sections |
| 21B | Standard mast middle section |
| 21C | Standard mast upper section |
| 22 | Level vials |
| 25 | Extension |
| 26 | Mobile Satellite Dish Antenna Stand |
| 27 | Elevation marker |
| 28 | Elevation gauge |
| 29 | Elevation locking knob |
| 31 | Skew/Tilt marker |
| 32 | Skew/Tilt gauge |
| 33 | Skew/Tilt locking knob |
| 36 | Standard post |
| 37 | Large post upper section |
| 38 | Keyed insert connector |
| 39 | Large post with mast |
| 40 | Opening in viewing section |
| 41 | Viewing tube |
| 42 | Viewing tube mast |
| 43 | Viewing mirror |
| 44 | Viewing section |
| 45 | Line of sight tool |
| 50 | Service Provider's satellite dish antenna (Prior Art) |

DETAIL DESCRIPTION OF THE PREFERRED EMBODIMENT

The mobile antenna stand 26 of the present invention comprises a stand base 20, a cone platform 15, a mast 21 removably received into a stand receiver 16 on the platform 15, and a line of sight tool 45. The mast 21 receives a post permanently connected to an antenna.

Figure 2:
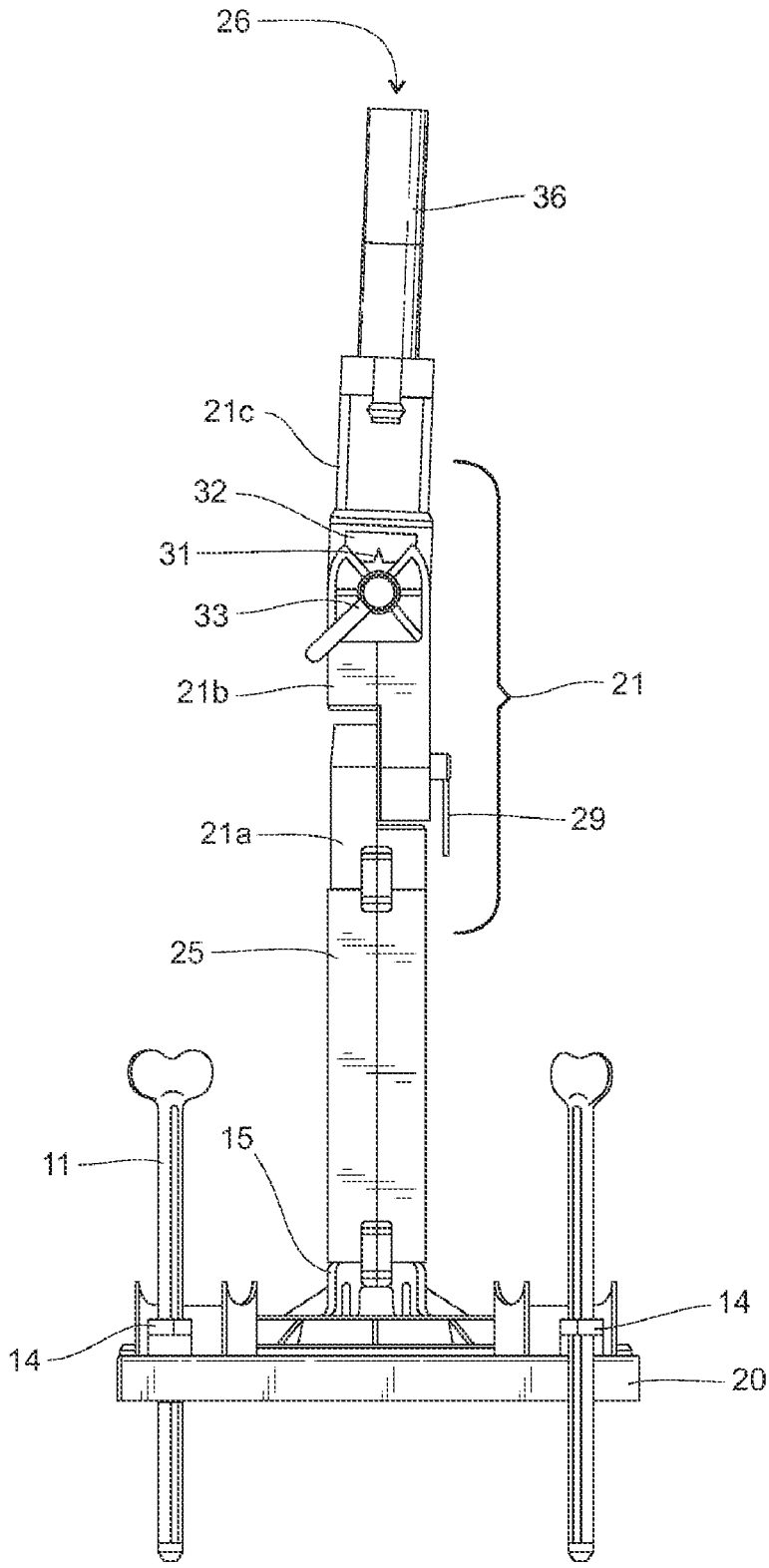
FIG. 2 is a side view of the dish antenna stand of FIG. 1.

As shown in FIG. 2, the stand 26 comprises a base 20 with four adjustable legs 11. Each of four stand legs 11 comprises a threaded rod 10. The limit of four legs 11 is not a restriction as additional legs 11 could be used, if needed, for support or stability. Conceivably, three legs could also be used. The legs 11 may be 13-inch long threaded nylon rods. Two nylon threaded nuts 14 on the legs through which the legs pass stabilize a leg height adjustment and removal of the legs 11 from the stand 26 to facilitate storage of the stand in a small area. Adjustment of the length of the legs 11 stabilizes the stand 26 and allows fine adjustment of the stand base 20 to assure it is level, or more precisely, that a standard mast 21 extending vertically from the base 20 is plumb regardless of the terrain. Adjustment of the length of each of the legs 11 also provides for fine-tuning of the signal strength as the direction of the antenna is fine-adjusted toward the satellite.

When the satellite dish antenna 50 is first mounted to the standard post 36 or large post with mast 39, the post with the attached antenna 50 needs to be calibrated with the stand 26. As stated above, the azimuth alignment arrow 18 is aligned to the correct azimuth reading on an azimuth retaining ring 17. Doing the calibration once then allows the starting azimuth to be set within one or two degrees whenever the stand 26 is set up at new locations.

Figure 4:
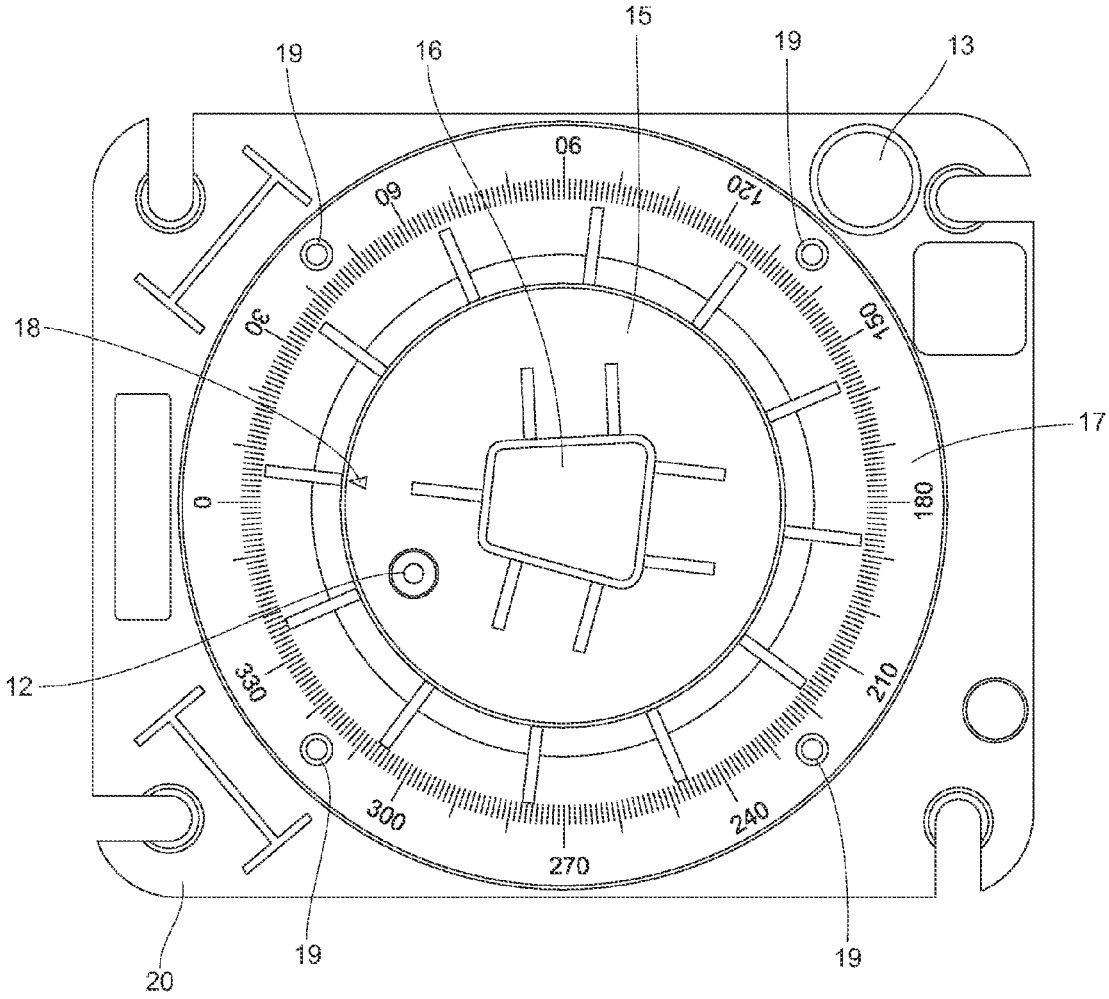
FIG. 4 is a top view of the dish antenna stand of FIG. 1.

As shown in FIG. 4, the stand base 20 is positioned with azimuthal settings in alignment with magnetic North, guided by a small compass 13 built into the stand base 20. Azimuth retaining ring 17 is attached to the stand base 20 by four bolts 19. The stand base 20 also includes the rotatable platform 15 as a platform held in place by the azimuth retaining ring 17. An azimuth alignment arrow 18 on the platform 15 is used to align the mast 16 and therefore a satellite dish antenna 50 attached thereto to an azimuth setting 17 for a current location. A base locking knob 12 locks the platform 15 in place relative to the stand base 20 after the platform 15 is rotated on the stand base 20 to the required position as indicated by the alignment arrow 18. This eliminates the need to loosen and tighten nuts on clamps of the satellite dish antenna 50 to posts supporting the antenna during the alignment process.

Figure 5B:
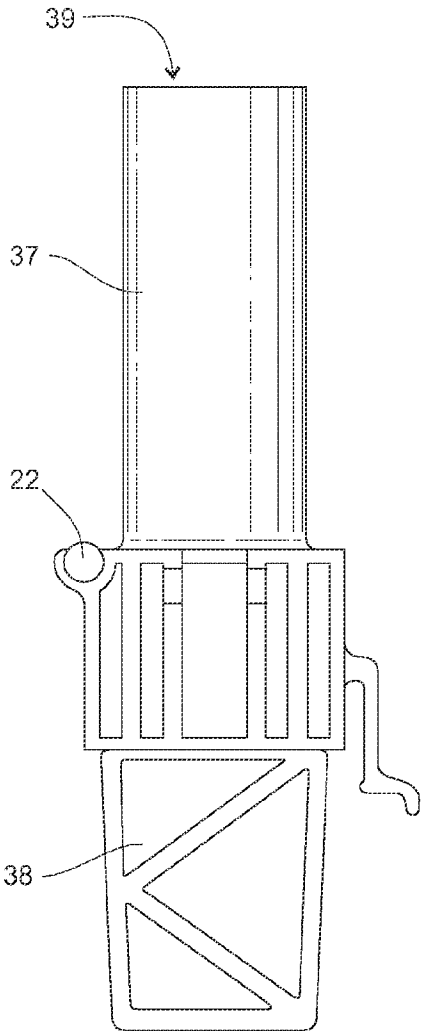
FIG. 5*b* is a side view of the post with a larger OD and a built in mast with spirit levels.
Figure 5A:
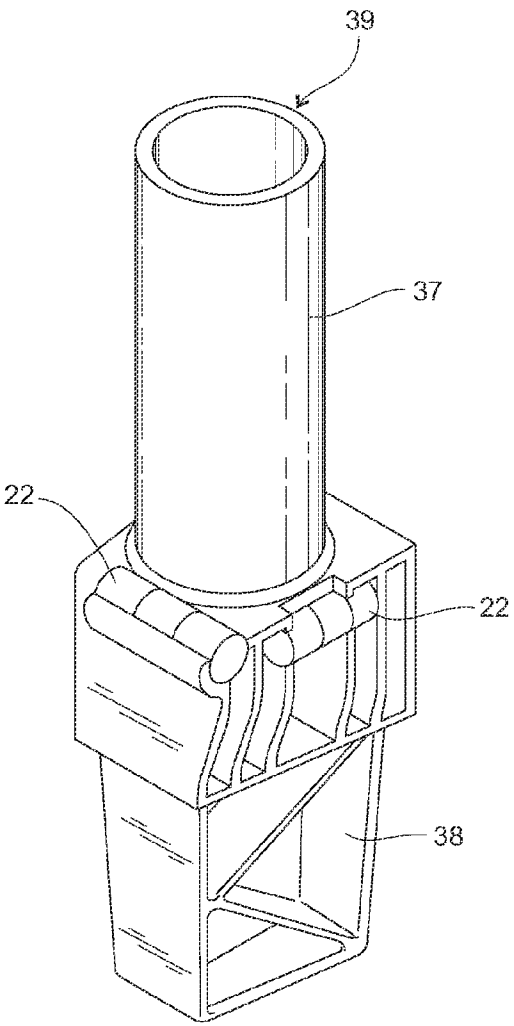
FIG. 5*a* is a perspective view of the of the post with a larger OD and a built in mast with spirit levels.

The base 20 includes a keyed cone receiver 16 in the rotatable platform 15. One of the standard mast 21, a mast extension 25, a standard post 36, or a larger post with mast 39 (See FIG. 5) may be selectively received into the receiver 16. To assure that each is connected in a same azimuthal alignment with the base 20 each has a keyed portion 38 matching the receiver 16. The mast extension 25 has its keyed portion on one end and an extension receiver the same as the cone receiver 16 on an opposite end.

Figure 3C:
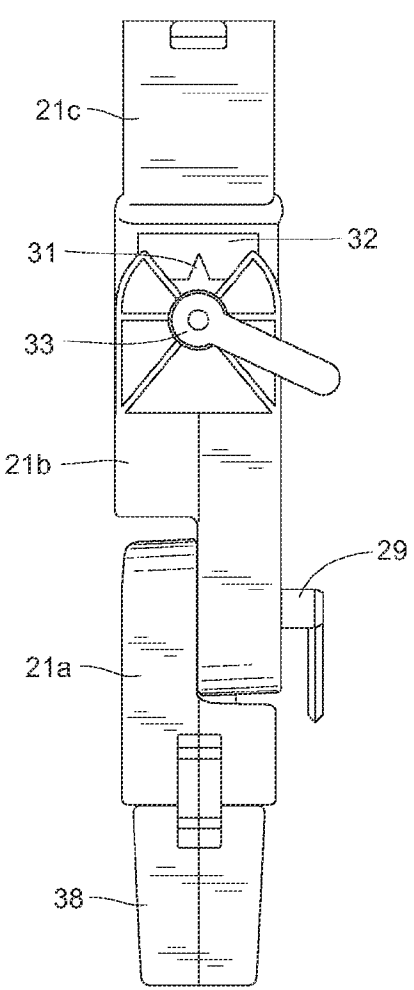
FIGS. 3*a*, 3*b*, and 3*c* are respective views of three sides of the mast of the stand of FIG. 1.
Figure 3B:
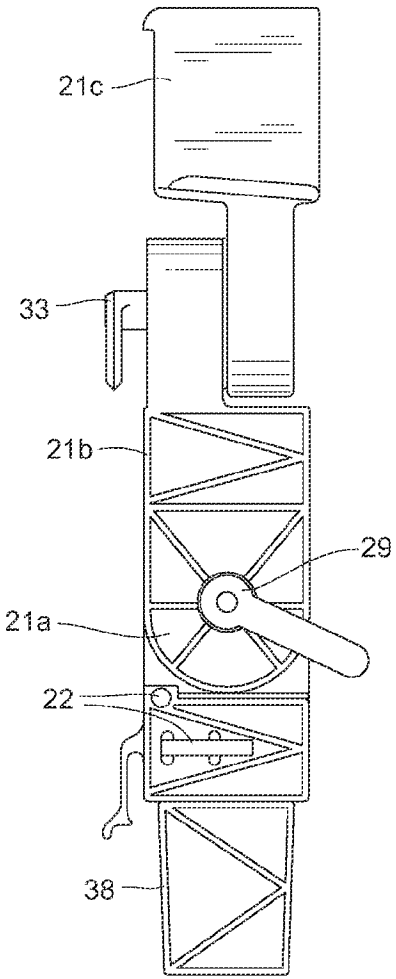
Figure 3A:
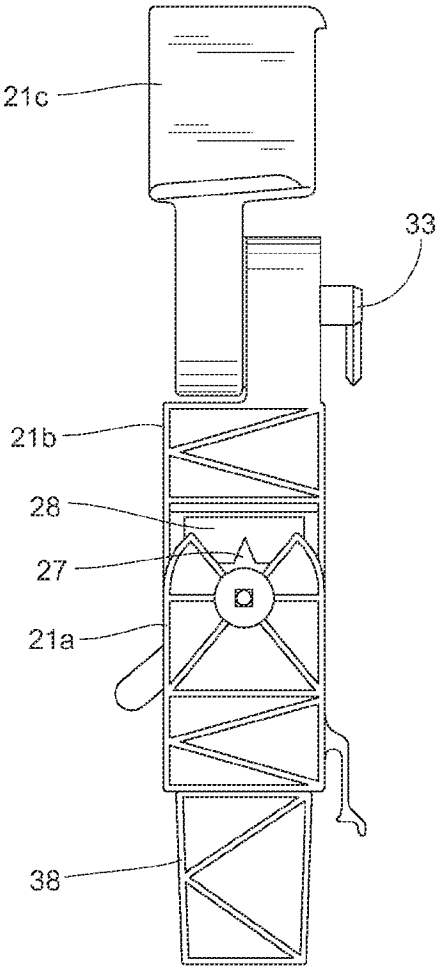

FIGS. 2 and 3 show the standard mast 21 having a lower section 21A rotatably connected to a middle section 21B on a first horizontal axis, and an upper section 21C rotatably connected to the middle section 21B on a second horizontal axis orthogonal to the first horizontal axis. Two mutually orthogonal spirit level vials 22 are attached horizontally on the lower section 21A with level vials 22 for use in adjusting the mast 21 to plumb with the base legs 11. Having the mast 21 plumb is necessary before starting any signal alignment of the satellite dish antenna 50. The middle section 21B includes an elevation gauge 28 that facilitates adjustment of elevation of the antenna by rotating the middle section 21B relative to the lower section 21A until a lower section marker 27 on the lower section 21A aligns with selective elevation markings 28 on the middle section 21B. The adjustment is secured with an elevation, or pitch locking knob 29. Similarly, the upper section 21C includes a tilt, or roll gauge 32 that facilitates adjustment of the tilt of the antenna by rotating the upper section 21C relative to the middle section 21B until a middle section marker 31 on the middle section 21B aligns with a selective tilt marking 28B on the upper section 21C. The adjustment is secured with a tilt locking knob 33.

Figure 6A:
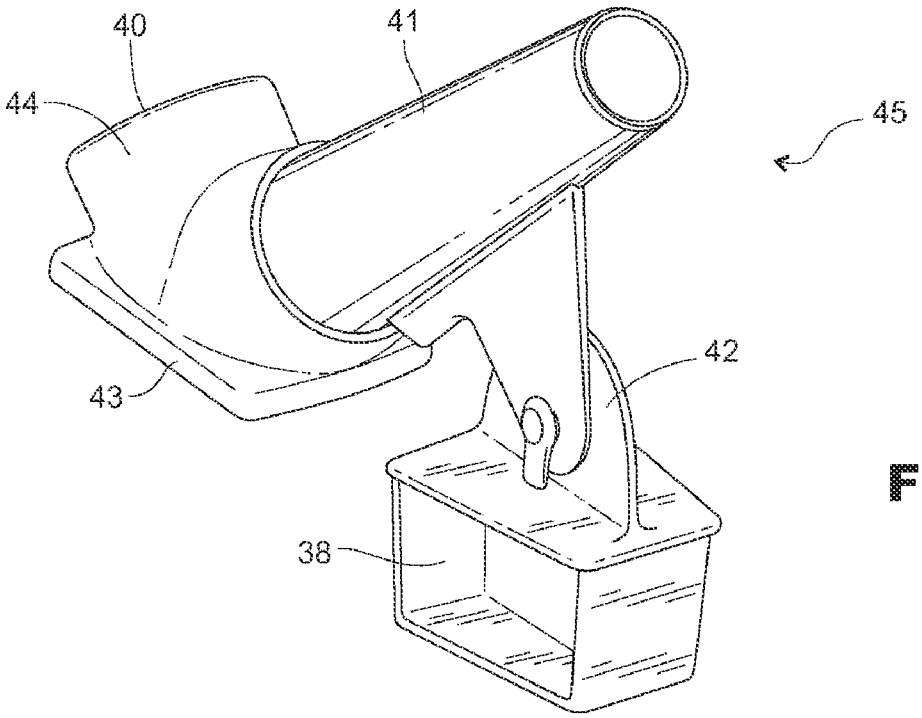
FIG. 6*a* is a perspective view of the line of sight tool.
Figure 6B:
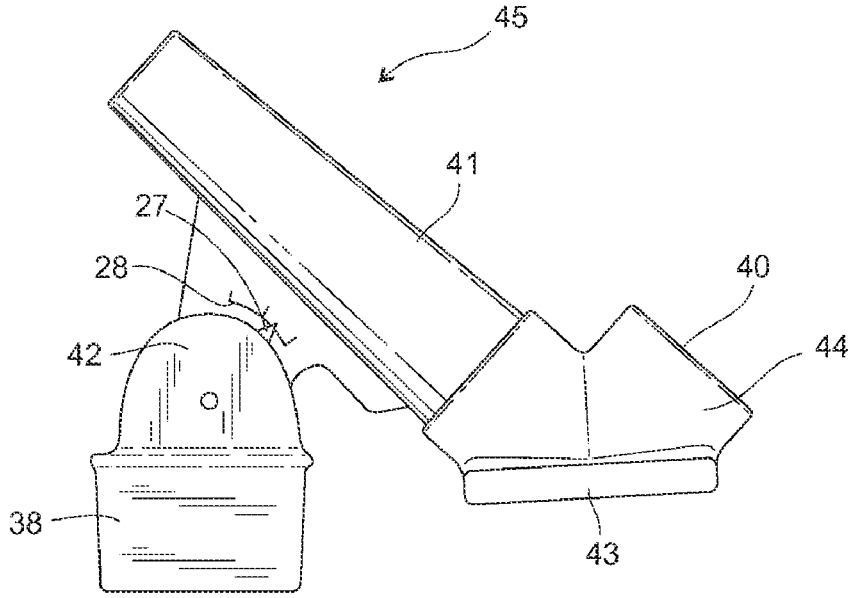
FIG. 6*b* is a side view of the line of sight tool of FIG. 6*a*.

FIG. 6 shows a line of sight tool 45 that is used to confirm a clear line of sight for the satellite dish antenna 50 which may be obstructed, such as by trees, buildings, other RVs, etc. An opening 40 in a viewing section 44 in the top of the line of sight tool 45 is directed at the sky. A viewing tube 41 is attached rotatably to a viewing tube mast 42 at a right angle to the viewing tube mast 42. The view tube mast 42 also includes a tool keyed portion 38'. A viewing mirror 43 is embedded in a viewing section 44 at an angle that will display to the observer a view received through the opening 40. The tool keyed portion base 38' is the same as keyed portion 38 of the mast 21 therein providing the same azimuthal orientation to the line of sight tool as the mast 21. When the line of sight tool 45 is inserted in the cone receiver 16 and the viewing tube 41 is rotated on the tool keyed portion 38' to the same elevation as the elevation setting for the antenna 50, the antenna line of sight is seen through the viewing tube. Because all of the keyed insert receivers 16 are identical, the line of sight tool 45 can be used instead of the satellite dish antenna 50 to look at the view without disturbing any adjustments.

Operation

The elevation and tilt settings on the standard satellite dish antenna 50 are set to neutral settings and do not need to change when in different locations. Once the standard satellite dish antenna (that employs a 1⅞ OD post 50) is mounted to the mast 21 no tools are needed for adjustment of the orientation of the antenna because all adjustments are done on the stand 26 and adjustment settings are maintained in the stand 26. Antenna elevation and tilt are initially adjusted on the stand to selective settings for locating the satellite. The azimuth orientation of the antenna is initially set to a given setting by rotating the platform 15 into alignment of the arrow 18 with a selective marker on the azimuth retaining ring 17. The stand 26 is then positioned on its legs to a magnetic North/South orientation guided by the compass 13 in the stand 26. The standard mast 21 is then adjusted to plumb by adjusting the legs 11 guided by the spirit level vials 22. The threaded rod legs 11 are then used to fine tune the elevation once a satellite signal is found.

In an alternate embodiment, employing newer dish antennas that fit a 2 inch and larger OD post and that have elevation and tilt gauges only use the azimuth gauge on the stand.

When an unobstructed view is in question, the line of sight tool 45 is used to visually see the same line of sight as the satellite dish antenna 50.

Having described the invention, what is claimed is as follows:

1. A mobile antenna stand, comprising a base supported by a plurality of legs that are adjustable in length, a platform rotatable on the stand about a vertical axis, a mast removably extending vertically from the platform on a first end, the mast adapted for connection to a mobile antenna dish on a second end, a receiver on the platform keyed adapted to releasably receive in a single orientation a keyed portion of the mast matching the receiver, wherein the mast comprises a lower section comprising said keyed portion of the mast, a middle section rotatably connected to the lower section about a first horizontal axis, and an upper section rotatably connected to the middle section about a second horizontal axis orthogonal to the first horizontal axis, said antenna being mountable on said upper section, a compass on the base, markings between said base and said platform indicating relative rotation of said platform relative to said base, markings between said lower section and said middle section indicating relative rotation of said lower section relative to said middle section, markings between said middle section and said upper section indicating relative rotation of said middle section relative to said upper section, an antenna direction of view thereby being adjustable in azimuth, tilt and elevation by adjustment of said platform relative said base, adjustment of said upper section relative to said middle section, and adjustment of said middle section relative to said lower section, respectively, said antenna directable to a unique position in the sky for acquisition of a signal from a satellite in that position by appropriately adjusting the position of the antenna on the stand.

2. The stand of claim 1 further comprising a retaining ring securing said platform to said base.

3. The stand of claim 2 wherein said markings between said platform and said base include markings on the retaining ring.

4. The stand of claim 3 wherein a direction of said antenna toward said unique position in the sky for acquisition of a signal from a satellite in that position is further adjustable by appropriately adjusting the orientation of the antenna and the stand by adjusting an effective length of each of the legs.

5. The stand of claim 4 further comprising a base locking knob releasably locking said platform in place relative to said base, an elevation locking knob releasably locking said middle section in place relative to said lower section, and a tilt locking knob releasably locking said upper section in place relative to said middle section.

6. The stand of claim 5 further including a line of sight tool comprising a tool keyed portion, a viewing tube mast on the tool keyed portion with an elevation adjustment, a viewing tube attached rotatably to the viewing tube mast at a relative angle to the viewing tube mast, a viewing section with an opening receiving a view of the sky, a viewing mirror is embedded in the viewing section adapted to display to an observer a view received through the opening, wherein the tool keyed portion is the same as the keyed portion of the mast therein providing the same azimuthal orientation to the line of sight tool as to the mast.

7. The stand of claim 1 wherein a direction of said antenna to said unique position in the sky for acquisition of a signal from a satellite in that position is further adjustable by appropriately adjusting the orientation of the antenna and the stand by adjusting an effective length of each of the legs.

8. The stand of claim 1 further comprising a base locking knob releasably locking said platform in place relative to said base.

9. The stand of claim 1 further comprising an elevation locking knob releasably locking said middle section in place relative to said lower section.

10. The stand of claim 1 further comprising a tilt locking knob releasably locking said upper section in place relative to said middle section.

11. The stand of claim 1 further including a line of sight tool comprising a tool keyed portion, a viewing tube mast on the tool keyed portion with an elevation adjustment, a viewing tube attached rotatably to the viewing tube mast at a relative angle to the viewing tube mast, a viewing section with an opening receiving a view of the sky, a viewing mirror is embedded in the viewing section adapted to display to an observer a view received through the opening, wherein the tool keyed portion is the same as the keyed portion of the mast therein providing the same azimuthal orientation to the line of sight tool as to the mast.

12. A mobile antenna stand, comprising a base supported by a plurality of legs that are adjustable in length, a platform rotatable on the stand about a vertical axis, a mast removably extending vertically from the platform on a first end, the mast adapted for connection to a mobile antenna dish on a second end, a receiver on the platform keyed adapted to releasably receive in a single orientation a keyed portion of the mast matching the receiver, wherein the mast comprises a lower section comprising said keyed portion of the mast, a middle section rotatably connected to the lower section about a first horizontal axis, and an upper section rotatably connected to the middle section about a second horizontal axis orthogonal to the first horizontal axis, said antenna being mountable on said upper section, a compass on the base, markings between said base and said platform indicating relative rotation of said platform relative to said base, an antenna direction of view thereby being adjustable azimuthally by adjustment of said platform relative said base, said antenna directable to a unique position in the sky for acquisition of a signal from a satellite in that position by appropriately adjusting the position of the antenna on the stand and adjusting an effective length of each of the legs.

13. The stand of claim 12 further comprising a base locking knob releasably locking said platform in place relative to said base.

14. The stand of claim 12 wherein a direction of said antenna to said unique position in the sky for acquisition of a signal from a satellite in that position is further adjustable by appropriately adjusting the orientation of the antenna and the stand by adjusting an effective length of each of the legs.

15. The stand of claim 12 further comprising a retaining ring securing said platform to said base.

16. The stand of claim 15 wherein said markings between said platform and said base include markings on the retaining ring.

17. The stand of claim 15 further comprising a base locking knob releasably locking said platform in place relative to said base, an elevation locking knob releasably locking said middle section in place relative to said lower section, and a tilt locking knob releasably locking said upper section in place relative to said middle section.

18. The stand of claim 12 further including a line of sight tool comprising a tool keyed portion, a viewing tube mast on the tool keyed portion with an elevation adjustment, a viewing tube attached rotatably to the viewing tube mast at a relative angle to the viewing tube mast, a viewing section with an opening receiving a view of the sky, a viewing mirror is embedded in the viewing section adapted to display to an observer a view received through the opening, wherein the keyed portion of the tool is the same as the keyed portion of the mast therein providing the same azimuthal orientation to the line of sight tool as to the mast.

19. A mobile antenna stand and line of sight tool, comprising a stand base supported by a plurality of legs that are adjustable in length, a platform rotatable on the stand about a vertical axis, a tool keyed portion with a keyed portion, a receiver on the platform keyed to releasably receive in a single orientation said keyed portion of the tool, said keyed portion of the tool matching the receiver, a compass on the base, markings between said base and said platform indicating relative rotation of said platform relative to said base, the line of sight tool comprising, a viewing tube mast on the tool keyed portion with an elevation adjustment, a viewing tube attached rotatably to the viewing tube mast at a relative angle to the viewing tube mast, a viewing section with an opening receiving a view of the sky, a viewing mirror embedded in the viewing section adapted to display to an observer a view received through the opening, the line of sight tool direction of view thereby being adjustable azimuthally by adjustment of said platform relative said base and in elevation by adjustment of the viewing tube mast, said antenna thereby being directable to a position in the sky for acquisition of a signal from a satellite in that position.

20. The stand of claim 19 wherein a direction of said antenna to said unique position in the sky for acquisition of a signal from a satellite in that position is further adjustable by appropriately adjusting the orientation of the antenna and the stand by adjusting an effective length of each of the legs.

* * * * *